US006629394B1

(12) United States Patent
Trevino

(10) Patent No.: US 6,629,394 B1
(45) Date of Patent: Oct. 7, 2003

(54) REBAR HANGER

(76) Inventor: Oscar Trevino, 4226 Stevenson Blvd., Fremont, CA (US) 94538

( * ) Notice: Subject to any disclaimer, the term of this patent is extended or adjusted under 35 U.S.C. 154(b) by 0 days.

(21) Appl. No.: 10/158,701

(22) Filed: May 30, 2002

Related U.S. Application Data

(63) Continuation-in-part of application No. 10/015,522, filed on Dec. 13, 2001, now abandoned.

(51) Int. Cl.[7] ..... E04C 5/16; E04C 5/00
(52) U.S. Cl. ..... 52/677; 52/699
(58) Field of Search ..... 52/677, 699, 692–702, 52/127.3, 712, 714; 249/91, 207, 210, 216

(56) References Cited

U.S. PATENT DOCUMENTS 4,301,638 A * 11/1981 Schmidgall ..... 52/687
4,391,429 A * 7/1983 Powell ..... 249/84
4,524,553 A 6/1985 Hacker
4,640,063 A * 2/1987 Ayala ..... 52/127.3
4,939,883 A 7/1990 Swenson
5,042,218 A 8/1991 Nasca et al.
5,388,804 A 2/1995 Cohen et al.
5,616,272 A * 4/1997 McCrystal ..... 249/207

* cited by examiner

*Primary Examiner*—Carl D. Friedman
*Assistant Examiner*—Kevin McDermott
(74) *Attorney, Agent, or Firm*—Jack Lo

(57) ABSTRACT

A rebar hanger is arranged for suspending rebars within a concrete form prior to pouring concrete. It is comprised of a downwardly directed form hook for hooking on top of a concrete form. A first rebar hook extends away from the lower end of an inner section of the form hook. The first rebar hook has a first downward dip for supporting a first rebar, and an upwardly directed and recurved distal end. A brace extends from the recurved distal end of the first rebar hook downwardly and outwardly toward an inner side of the concrete form. An inner end of the brace is positioned against the inner side of the form substantially below a position of the first hook. A second rebar hook extends downwardly and inwardly from the inner end of the brace. The second rebar hook has a second downward dip for supporting a second rebar.

11 Claims, 6 Drawing Sheets

REBAR HANGER

CROSS REFERENCE TO RELATED APPLICATION

This is a continuation-in-part of application Ser. No. 10/015,522, filed on Dec. 13, 2001, now abandoned.

BACKGROUND OF THE INVENTION

1. Field of the Invention

This invention relates generally to hangers for suspending concrete reinforcement bars.

2. Prior Art

Reinforced concrete is made by positioning steel reinforcement bars or rebars inside a wooden form, and pouring concrete into the form. The rebars must be spaced from the interior surfaces of the form to embed them deep enough in the concrete. A rebar is typically positioned inside a form by hammering long nails horizontally into the interior surface of the form, and supporting the rebar on the nails away from the inside of the form. An additional rebar may be suspended under the first rebar with wires. This method is very slow and inaccurate in positioning the rebars.

A better solution is the prior art rebar hanger shown in FIG. 1. It is comprised of a first hook 10 for hooking on top of a wooden concrete form 11, and a second hook 12 extending away from the first hook for supporting a rebar 13 within the form. Several hooks are positioned on the form for supporting a long rebar. However, it can only support a single rebar. Any additional rebars can only be attached by hanging them under the first rebar with wires tied around the rebars. Further, the arm tends to sag under the weight of additional rebars.

OBJECTIVES OF THE INVENTION

The objectives of the present rebar hanger are:

to suspend a rebar inside a concrete form prior to pouring the concrete;

to be strong enough for suspending a plurality of rebars without sagging;

to be easy to install;

to be easy to remove; and to be easy to make.

Further objectives of the present invention will become apparent from a consideration of the drawings and ensuing description.

BRIEF SUMMARY OF THE INVENTION

A rebar hanger is arranged for suspending rebars within a concrete form prior to pouring concrete. It is comprised of a downwardly directed form hook for hooking on top of a concrete form. Form hook is comprised of a transverse top section for engaging a top of the form, a downwardly projecting outer section for engaging an outer side of the form, and a downwardly projecting inner section for engaging an inner side of the form. The outer section of the form hook has an outwardly angled lower end for being pried off by the claw of a hammer if the hanger needs to be removed. A first rebar hook extends away from the lower end of the inner section of the form hook. The first rebar hook has a first downward dip for supporting a first rebar, and an upwardly directed and recurved distal end. A brace extends from the recurved distal end of the first rebar hook downwardly and outwardly toward the inner side of the concrete form. An inner end of the brace is positioned against the inner side of the form substantially below a position of the first hook. A second rebar hook extends downwardly and inwardly from the inner end of the brace. The second rebar hook has a second downward dip for supporting a second rebar, and an upwardly directed distal end.

DRAWING REFERENGE NUMERALS

| | | | |
|---|---|---|---|
| 10. | Concrete Form Hook | 11. | Concrete Form |
| 12. | Rebar Hook | 13. | Rebar |
| 20. | Concrete Form Hook | 21. | Concrete Form |
| 22. | Transverse Section | 23. | Outer Section |
| 24. | Inner Section | 25. | Outwardly Angled Lower End |
| 26. | First Rebar Hook | 27. | Downward Dip |
| 28. | First Rebar | 29. | Recurved Distal End |
| 30. | Brace | 31. | Second Rebar |
| 32. | Wire | 33. | Second Rebar Hook |
| 34. | Second Downward Dip | 35. | Distal End |
| 36. | Brace | 37. | Second Rebar Hook |
| 38. | Recurved Lower End | 39. | Second Downward Dip |
| 40. | Distal End | 41. | First Rebar Hook |
| 42. | First Downward Dip | 43. | Second Downward Dip |
| 44. | First Rebar | 45. | Second Rebar |
| 46. | Brace | 47. | Recurved Distal End |
| 48. | Second Rebar Hook | 49. | Third Downward Dip |
| 50. | Fourth Downward Dip | 51. | Third Rebar |
| 52. | Fourth Rebar | 53. | Supplemental Hanger |
| 54. | Top Hook | 55. | Supplemental Hook |
| 56. | Vertical Portion | 57. | Recurved Distal End |
| 58. | Supplemental Hook | 59. | Supplemental Hook |
| 60. | Brace | 61. | Form Hook |
| 62. | First Rebar Hook | 63. | First Downward Dip |
| 64. | Brace | 65. | Recurved Distal End |
| 66. | Second Rebar Hook | 67. | Second Downward Dip |
| 68. | Distal End | 69. | Anchor Bolt Bracket |
| 70. | Anchor Bolt | 71. | Top Loop |
| 72. | Vertical Portion | 73. | Bottom Loop |
| 74. | Horizontal Portion | 75. | Connecting Member |

DETAILED DESCRIPTION OF THE INVENTION

FIG. 2

Figure 1:
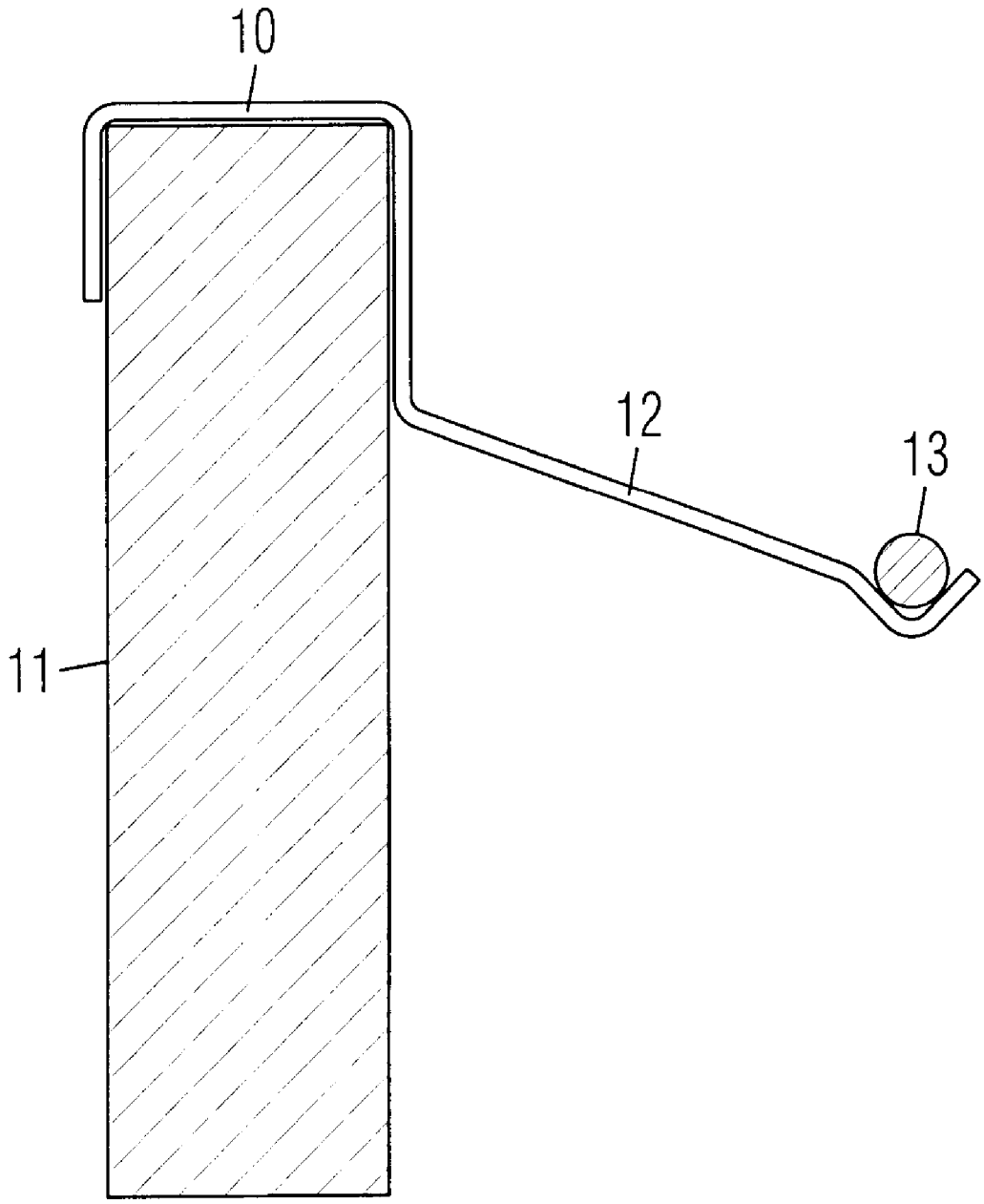
Fig. 1 Prior Art
FIG. 1 is a side view of a prior art rebar hanger.
Figure 2:
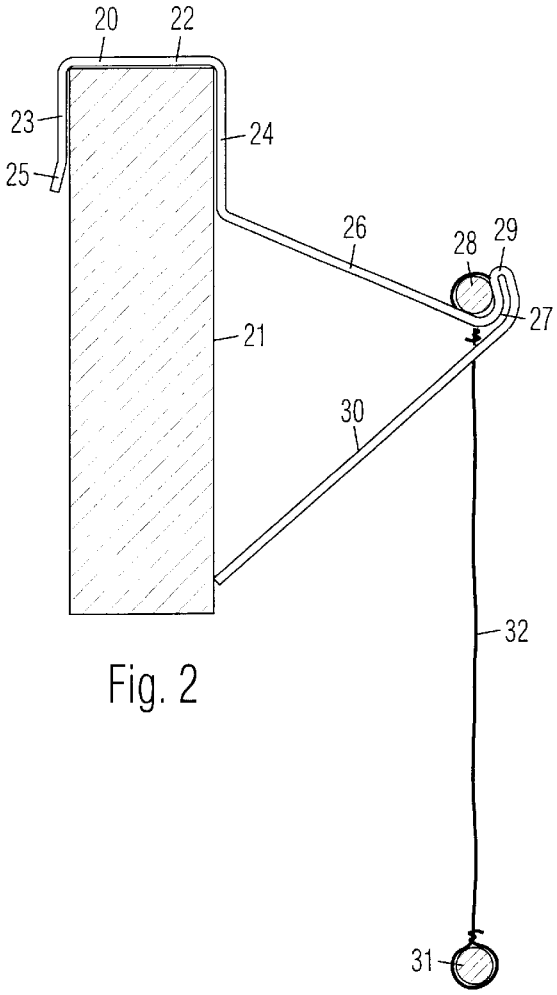
FIG. 2 is a side view of a first embodiment of the present rebar hanger.

A rebar hanger is provided for suspending one or more rebars within a concrete form prior to pouring the concrete. A first embodiment of the rebar hanger is shown in a side view in FIG. 2. It is comprised of a form hook 20 for easily hooking on top of a wooden concrete form 21. Form hook 20 is comprised of a transverse section 22 for engaging a top of form 21, a downwardly projecting outer section 23 for engaging an outer side of form 21, and a downwardly projecting inner section 24 for engaging an inner side of form 21. Outer section 23 of form hook 20 has an outwardly angled lower end 25 for being pried off by the claw of a hammer if the rebar hanger needs to be removed.

A first rebar hook 26 extends away from a lower end of inner section 24 of form hook 20. First rebar hook 26 has a first downward dip 27 for supporting a first rebar 28, and an upwardly directed and recurved distal end 29. A brace 30 extends from recurved distal end 29 of first rebar hook 26 downwardly and inwardly toward the inner side of form 21. A lower end of brace 30 is positioned against the inner side of form 21 substantially below a position of first rebar hook 26 for preventing first rebar hook 26 from sagging. Brace 30 may be of any shape as long as it has a portion which is positioned to engage the inner side of form 21. A second rebar 31 is supported directly under first rebar 28 by a wire 32 tied to first rebar 28 and second rebar 31.

FIG. 3

Figure 3:
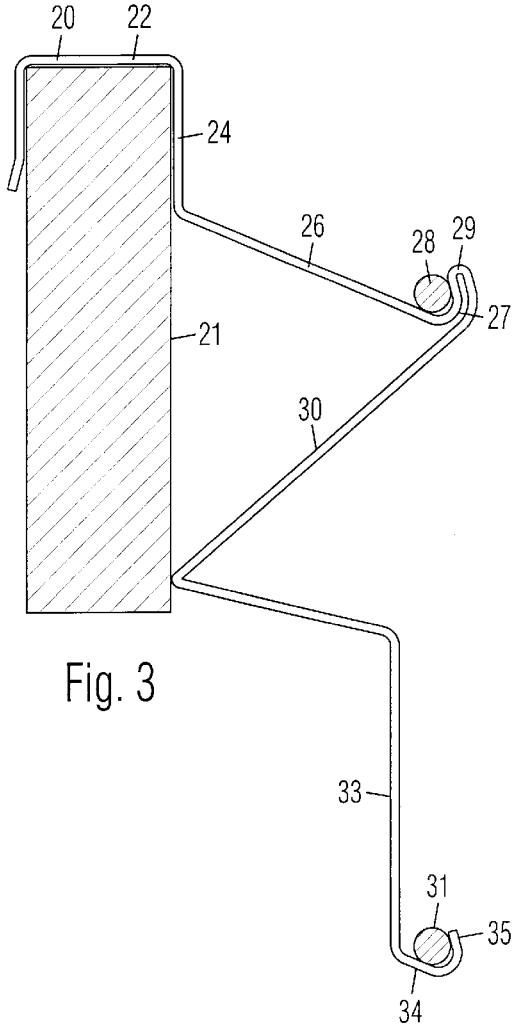
FIG. 3 is a side view of a second embodiment thereof.

A second embodiment of the rebar hanger is shown in a side view in FIG. 3. It is comprised of form hook 20, first rebar hook 26, and brace 30 which are the same as in FIG. 2, and further including a second rebar hook 33 extending outwardly and downwardly from the inner end of brace 30. Second rebar hook 33 has a second downward dip 34 for supporting second rebar 31, and an upwardly directed distal end 35. Second rebar hook 33 may be of any shape, as long as it positions second downward dip 34 below first downward dip 27 of first rebar hook 26. The entire rebar hanger is shaped for being bent from a single continuous piece of steel rod, so that it is economical to produce. In any embodiment, the rebar hanger may be sized for fitting any size concrete form, and for positioning the rebars at any positions relative to the concrete form.

FIGS. 4–5

Figure 4:
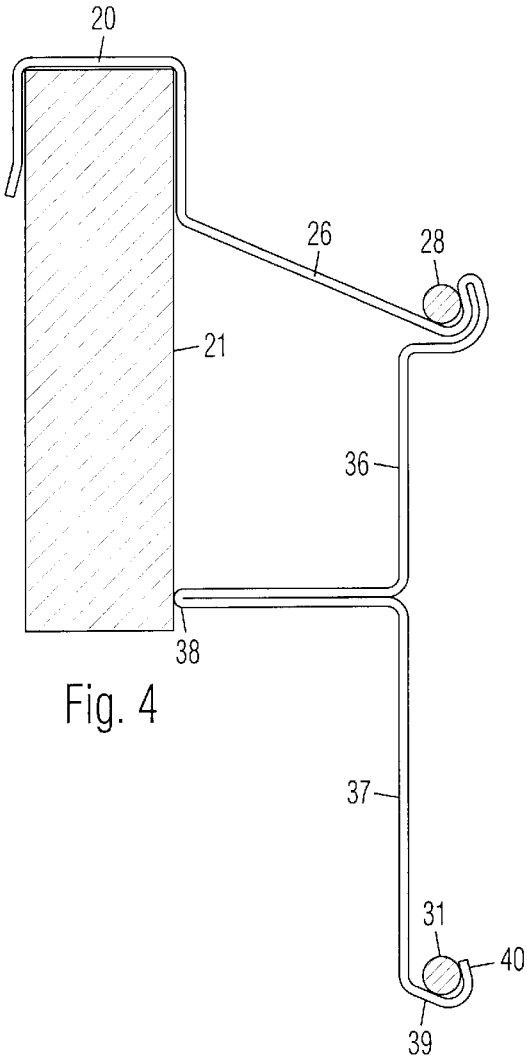
FIG. 4 is a side view of a third embodiment thereof.
Figure 5:
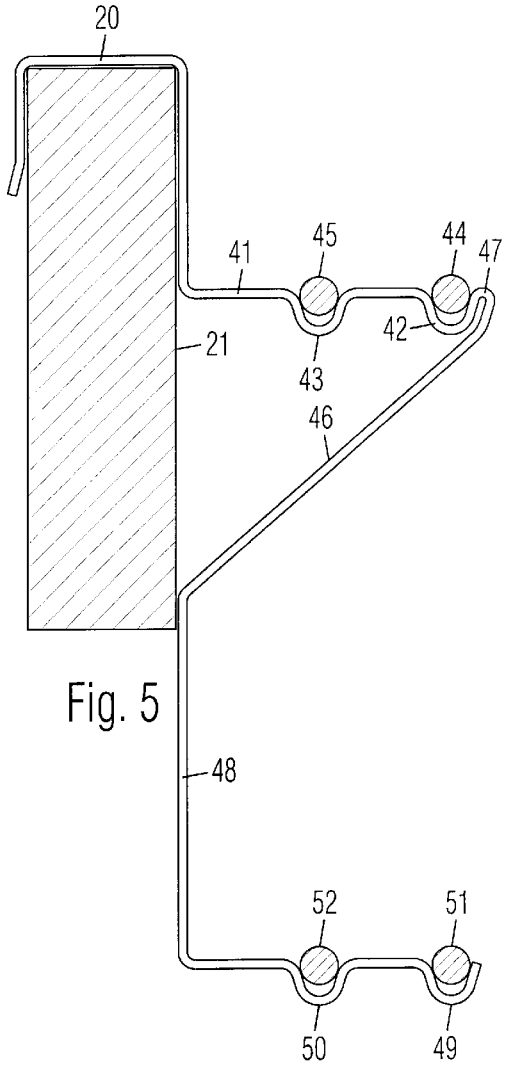
FIG. 5 is a side view of a fourth embodiment thereof.

The first rebar hook, the brace, and the second rebar hook may be of other suitable shapes. For example, FIG. 4 shows a brace 36 comprised of a right-angled brace, and a second rebar hook 37 comprised of a right-angled hook connected to a recurved lower end 38 of brace 36. Second rebar hook 37 also has a downward second dip 39 with an upwardly directed distal end 40. FIG. 5 shows a first rebar hook 41 comprised of a horizontal hook with first and second downward dips 42 and 43 for supporting first and second rebars 44 and 45, a diagonal brace 46 extending from a recurved distal end 47 of first dip 42, and a second rebar hook 48 connected to a lower end of brace 46. Second rebar hook 48 is comprised of a L-shaped hook with third and fourth downward dips 49 and 50 for supporting third and fourth rebars 51 and 52.

In any embodiment, additional levels of rebars hooks may be connected below the second rebar hook, and each rebar hook may include additional dips for supporting additional rebars on each level.

FIG. 6

Figure 6:
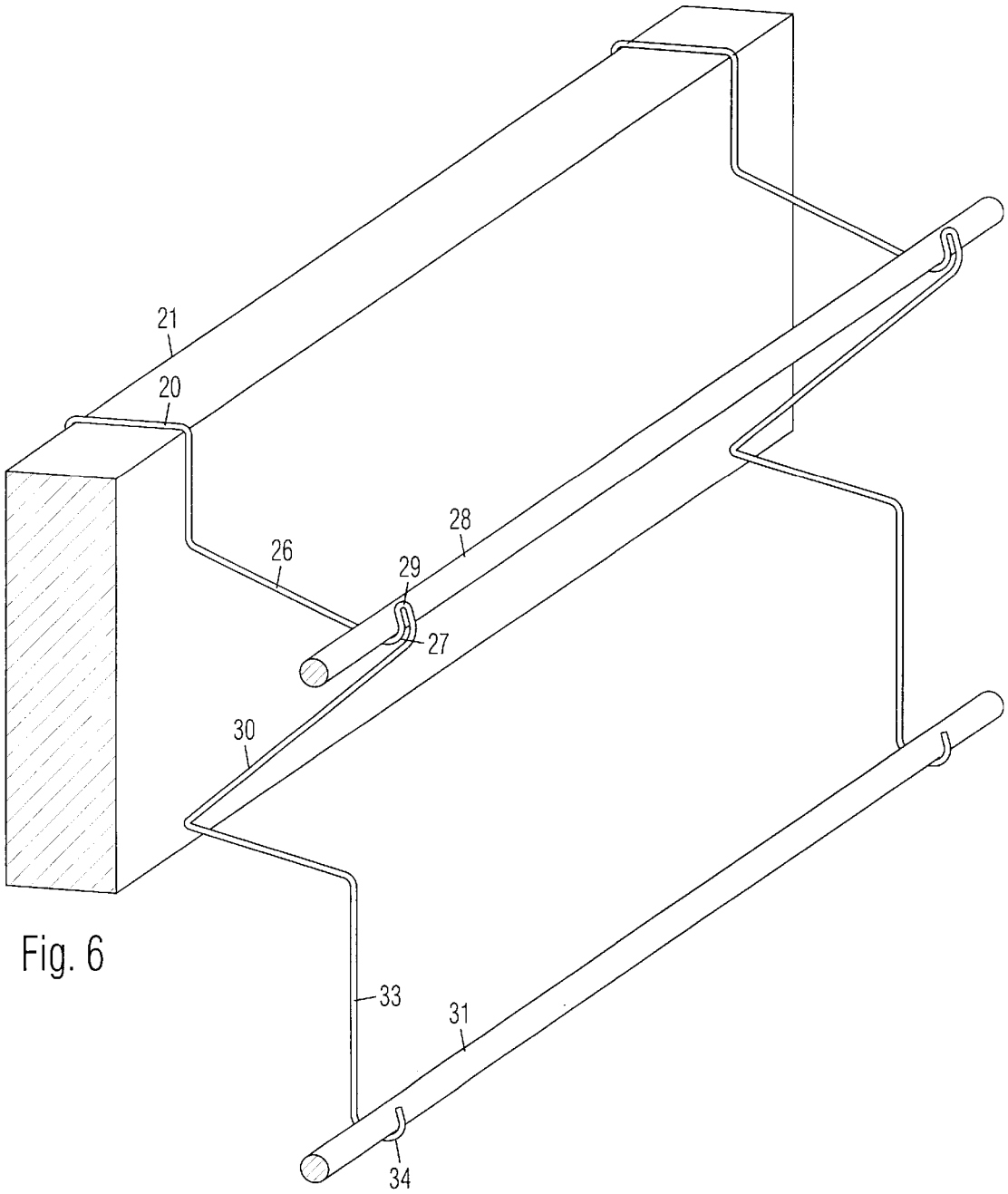
FIG. 6 is a side perspective view of the rebar hanger in use.

The rebar hanger is shown in use in FIG. 6. As an example, the embodiment of FIG. 3 is shown, but other embodiments are used in the same manner. A plurality of rebar hangers are attached to concrete form at spaced positions for supporting rebars.

FIG. 7

Figure 7:
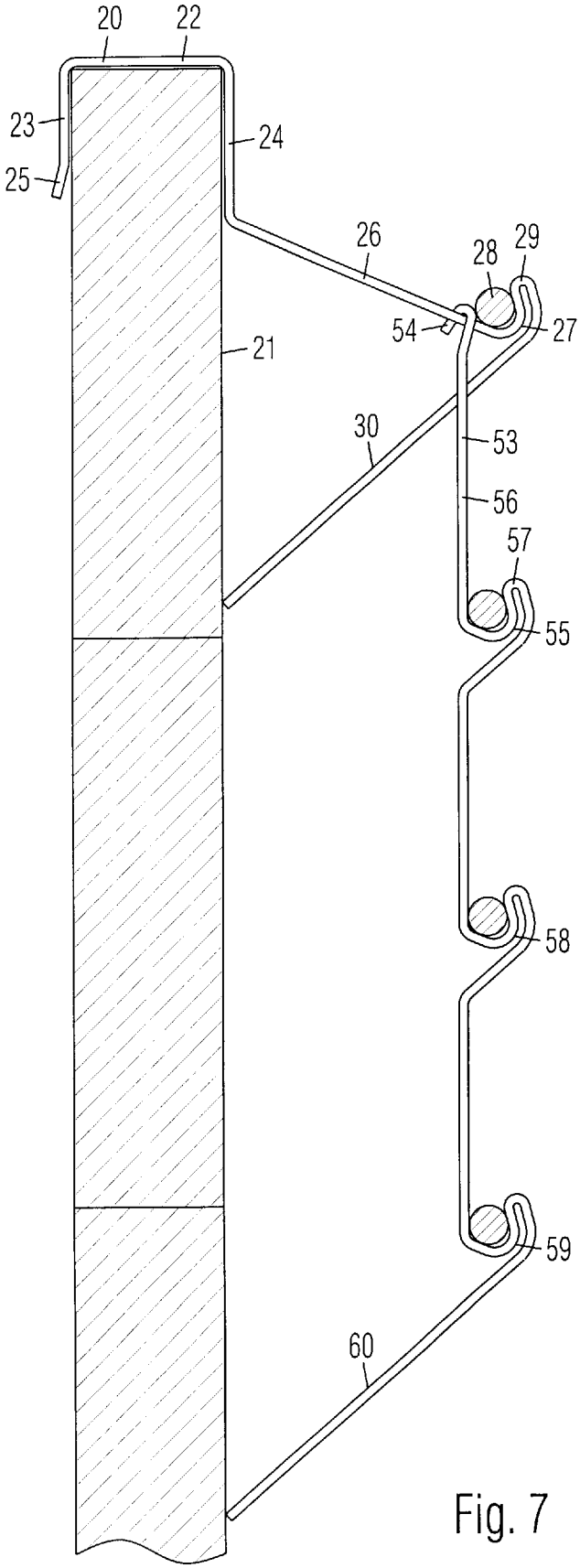
FIG. 7 is a fifth embodiment of the rebar hanger.

A fifth embodiment of the rebar hanger is shown in a side view in FIG. 7. It has the same upper portion as the embodiment shown in FIG. 2, except that the wire for hanging additional rebars is replaced with a supplemental hanger 53, which is comprised of a downwardly directed top hook 54 detachably hooked onto first rebar hook 26, and an upwardly directed supplemental hook 55 connected to top hook 54. Supplemental hook 55 includes a vertical portion 56 and a recurved distal end 57. Additional supplemental hooks 58 and 59 are connected in series below supplemental hook 55. A supplemental brace 60 extends from the lowest supplemental hook to engage the concrete form. Alternatively, more or fewer supplemental hooks may be provided on each supplemental hanger, and additional supplemental hangers may be connected together vertically to suspend even more rebars.

FIG. 8

Figure 8:
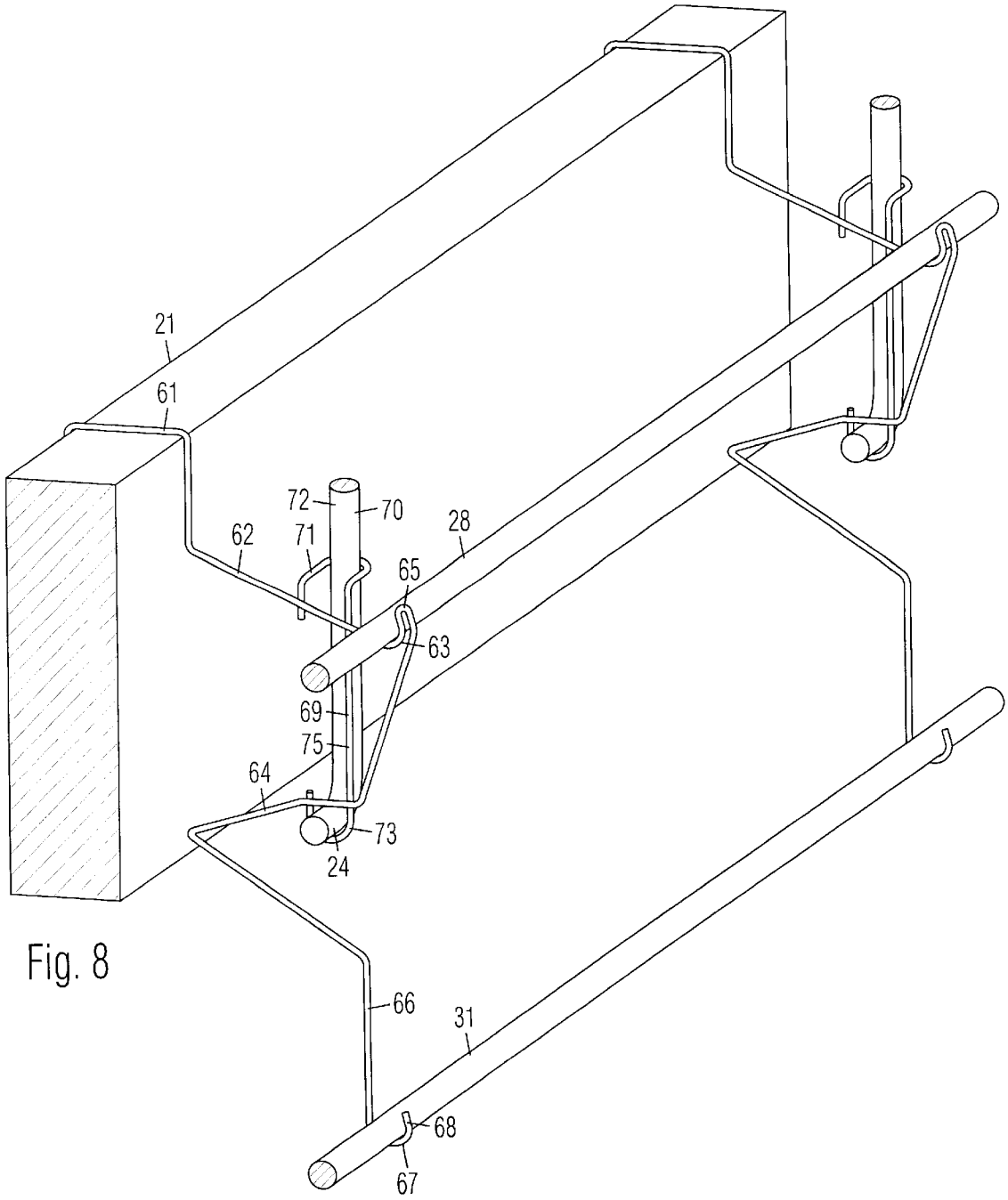
FIG. 8 is a sixth embodiment of the rebar hanger.

A sixth embodiment of the rebar hanger is shown in a side perspective view in FIG. 8. It is comprised of a form hook 61 for hanging on concrete form 21. A first rebar hook 62 extends from an inner end of form hook 61. A downward dip 63 on rebar hook 62 is arranged for supporting a first rebar 28. A brace 64 extends from a recurved distal end 65 of rebar hook 62 downwardly and inwardly against the inner side of form 21. Brace 64 may be of any shape as long as it has a portion which is positioned to engage the inner side of form 21.

A second rebar hook 66 extends outwardly and downwardly from the inner end of brace 64. Second rebar hook 66 has a second downward dip 67 for supporting second rebar 31, and an upwardly directed distal end 68. Second rebar hook 66 may be of any shape, as long as it positions second downward dip 67 below first downward dip 63 of first rebar hook 62.

An anchor bolt bracket 69 is attached vertically across first rebar hook 62 and brace 64 for engaging a J-shaped anchor bolt 70 which extends down from the floor above (not shown).

Bracket 69 is comprised of a horizontal top loop 71 for encircling a vertical portion 72 of anchor bolt 70, and a vertical bottom loop 73 for encircling a horizontal portion 74 of anchor bolt 70. A connecting member 75 is connected between top loop 71 and bottom loop 73. Alternatively, bottom loop 73 may be horizontal for encircling an anchor bolt with a vertical lower end.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A rebar hanger, comprising:

a form hook for hooking on top of a concrete form, wherein said form hook is comprised of a transverse section for engaging a top of said form, a downwardly projecting outer section for engaging an outer side of said form, and a downwardly projecting inner section for engaging an inner side of said form;

a first rebar hook extending outwardly from a lower end of said inner section of said form hook, wherein said first rebar hook has a first downward dip for supporting a first rebar, and an upwardly directed and recurved distal end; and a brace extending inwardly from said recurved distal end of said first rebar hook for engaging said inner side of said form and preventing said first rebar hook from sagging; and a second rebar hook extending outwardly from an inner end of said brace, wherein said second rebar hook includes a second downward dip for supporting a second rebar below said first rebar, said second rebar hook includes an upwardly directed distal end;

wherein said rebar hanger is shaped for being entirely bent from a single continuous piece of steel rod for economy.

2. The rebar hanger of claim 1, wherein a lower end of said brace is positioned against said inner side of said form substantially below a position of said first rebar hook for strength.

3. The rebar hanger of claim 1, wherein said brace is comprised of a right-angled brace with a vertical section extending down from said recurved distal end of said first rebar hook, and a horizontal section extending from a lower end of said vertical section for engaging said inner side of said form, said second rebar hook is comprised of a right-angled hook connected to a recurved end of said horizontal section of said right-angled brace.

4. The rebar hanger of claim 1, wherein said first rebar hook is comprised of a horizontal hook with first and second downward dips for supporting said first rebar and a second rebar, and second rebar hook is comprised of a L-shaped hook with third and fourth downward dips for supporting third and fourth rebars.

5. The rebar hanger of claim 1, further including an outwardly angled lower end on said outer section of said form hook for enabling said rebar hanger to be pried off from said concrete form.

6. A rebar hanger, comprising:

a form hook for hooking on top of a concrete form, wherein said form hook is comprised of a transverse section for engaging a top of said form, a downwardly projecting outer section for engaging an outer side of said form, and a downwardly projecting inner section for engaging an inner side of said form;

a first rebar hook extending outwardly from a lower end of said inner section of said form hook, wherein said first rebar hook has a first downward dip for supporting a first rebar, and an upwardly directed and recurved distal end; and a brace extending inwardly from said recurved distal end of said first rebar hook for engaging said inner side of said form and preventing said first rebar hook from sagging;

a supplemental hanger comprised of a downwardly directed top hook hooked onto said first rebar hook, and an upwardly directed supplemental hook connected to said top hook, wherein said supplemental hook includes a vertical portion connected to said top hook, a supplemental dip at a lower end of said vertical portion for supporting a supplemental rebar directly below said rebar, and a recurved distal end on said dip; and a supplemental brace extending inwardly from said recurved distal end of said supplemental hook for engaging said inner side of said concrete form.

7. The rebar hanger of claim 6, further including additional supplemental hooks connected in series between said supplemental hook and said supplemental brace.

8. A rebar hanger, comprising:

a form hook for hooking on top of a concrete form, wherein said form hook is comprised of a transverse section for engaging a top of said form, a downwardly projecting outer section for engaging an outer side of said form, and a downwardly projecting inner section for engaging an inner side of said form;

a first rebar hook extending outwardly from a lower end of said inner section of said form hook, wherein said first rebar hook has a first downward dip for supporting a first rebar, and an upwardly directed and recurved distal end; and a brace extending inwardly from said recurved distal end of said first rebar hook for engaging said inner side of said form and preventing said first rebar hook from sagging; and an anchor bolt bracket attached to said first rebar hook and said brace for engaging a vertical anchor bolt, wherein said bracket is comprised of a top loop attached to said first rebar hook and a bottom loop attached to said brace for encircling said anchor bolt.

9. The rebar hanger of claim 8, wherein said top loop is horizontal for encircling a vertical portion of said anchor bolt, and said bottom loop is vertical for encircling a horizontal portion of said anchor bolt.

10. The rebar hanger of claim 8, further including a connecting member connected between said top loop and said bottom loop.

11. The rebar hanger of claim 8, further including a second rebar hook extending outwardly from an inner end of said brace, wherein said second rebar hook includes a second downward dip for supporting a second rebar below said first rebar, said second rebar hook includes an upwardly directed distal end.

* * * * *